US005585340A

United States Patent [19]

Held, III

[11] Patent Number: 5,585,340

[45] **Date of Patent: *Dec. 17, 1996**

[54] SUBSTANTIALLY PHOSPHATE FREE ACIDIC CLEANER FOR PLASTICS

[75] Inventor: Theodore D. Held, III, Grosse Pointe Farms, Mich.

[73] Assignee: Henkel Corporation, Plymouth Meeting, Pa.

[ * ] Notice: The term of this patent shall not extend beyond the expiration date of Pat. No. 5,389,283.

[21] Appl. No.: 342,547

[22] Filed: Nov. 21, 1994

Related U.S. Application Data

[63] Continuation-in-part of Ser. No. 974,369, Nov. 10, 1992, Pat. No. 5,389,283, which is a continuation of Ser. No. 628,245, Dec. 14, 1990, abandoned.

[51] Int. Cl.[6] ..... C11D 1/22; C11D 1/72; C11D 3/20

[52] U.S. Cl. ..... 510/244; 510/424; 510/488; 134/40

[58] Field of Search ..... 252/174.19, 142, 252/559, 106, 174.21; 134/40

[56] References Cited

U.S. PATENT DOCUMENTS

| | | | |
|---|---|---|---|
| 3,218,260 | 11/1965 | Lewandowski | 252/142 |
| 3,928,249 | 12/1975 | Nunziata et al. | 252/526 |
| 4,079,020 | 3/1978 | Mills et al. | 252/547 |
| 4,144,201 | 3/1979 | Winterbotham et al. | 252/547 |
| 4,235,752 | 11/1980 | Rossall et al. | 252/551 |
| 4,247,408 | 1/1981 | Imamura et al. | 252/143 |
| 4,569,782 | 2/1986 | Disch et al. | 252/106 |
| 4,895,658 | 1/1990 | Amjad | 210/636 |
| 5,389,283 | 2/1995 | Held, III | 252/174.19 |

FOREIGN PATENT DOCUMENTS

| | | |
|---|---|---|
| 0213500 | 3/1987 | European Pat. Off. . |
| 208177 | 3/1984 | German Dem. Rep. . |
| TO 46736 | 11/1988 | Hungary . |
| 53-018606 | 2/1978 | Japan . |
| 57-105494 | 6/1982 | Japan . |
| 61-118499 | 6/1986 | Japan . |
| 61-276899 | 12/1986 | Japan . |
| 62-004792 | 1/1987 | Japan . |
| 536221 | 3/1977 | U.S.S.R. . |
| 1487715 | 10/1977 | United Kingdom . |

*Primary Examiner*—Erin M. Harriman
*Attorney, Agent, or Firm*—Ernest G. Szoke; Wayne C. Jaeschke; Norvell E. Wisdom, Jr.

[57] ABSTRACT

An effective phosphate free and organic solvent free aqueous acidic cleaner for soiled plastic surfaces is a low foaming aqueous solution or dispersion that consists essentially of water and:

(A) hydroxycarboxylic and/or dicarboxylic acid or acids;

(B) nonionic surfactant; and, optionally, one or more of the following:

(C) salts including anions of hydroxycarboxylic and/or dicarboxylic acid or acids, preferably anions of the same acid or acids as specified for part (A); and (D) a sufficient amount of hydrotrope material to produce a stable homogeneous solution or dispersion of components (A) through (C) in water; and (E) a sufficient amount of a biocidal material to inhibit growth of any bacteria and/or fungi that may be present in the composition.

20 Claims, No Drawings

SUBSTANTIALLY PHOSPHATE FREE ACIDIC CLEANER FOR PLASTICS

CROSS-REFERENCE TO RELATED APPLICATIONS

This application is a continuation-in-part of application Ser. No. 07/974,369 filed Nov. 10, 1992, now U.S. Pat. No. 5,389,283 which was a continuation of application Ser. No. 07/628,245 filed Dec. 14, 1990, now abandoned.

BACKGROUND OF THE INVENTION

1. Field of the Invention

This invention relates to compositions and processes for cleaning engineering plastic surfaces. Surfaces that can be effectively cleaned according to this invention include, but are not limited to, polyester sheet molding compound ("SMC"); poly{vinyl chloride} ("PVC") homopolymers and copolymers; polyurethane and polyurea plastic surfaces such as those of objects made commercially by injection molding from these plastics; terpolymers of acrylonitrile, butadiene, and styrene ("ABS"); poly{phenylene oxide} ("PPO") and copolymers of "phenylene oxide" with other materials such as polyamides; polycarbonate ("PCO") polymers and copolymers; and thermoplastic polyolefins ("TPO"). The invention is particularly suited to cleaning plastics, more particularly SMC, that contain solid filler materials, especially those that are chemically alkaline, such as calcium carbonate. Common commercially available types of such SMC materials include PHASE ALPHA™ from Ashland Chemical Co., SL 1223™ from Eagle Picher Co., Type 7113™ from Gencorp, and RI 9486™ from Rockwell International, Inc.

The compositions of the invention are substantially or entirely free from phosphate and can be substantially or entirely free from volatile organic solvents as well, and are therefore less polluting than the now common commercial acidic cleaners for plastics.

2. Statement of Related Art and Object of the Invention

Numerous compositions and processes for cleaning plastic surfaces are currently known in the art. Most of them include acid, surfactant(s), and phosphates. In some locations, however, phosphates are forbidden or severely limited to avoid potential pollution and eutrophication of bodies of water that receive discharges of industrial waste water. Thus, compositions that contain little or no phosphate but are still effective cleaners have been sought.

DESCRIPTION OF THE INVENTION

General Principles of Description

Except in the claims and the operating examples, or where otherwise expressly indicated, all numbers in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, or as reduced or increased in amount in situ by acid-base reactions, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term "mole" and its variations may be applied to elemental, ionic, and any other chemical species defined by number and type of atoms present, as well as to compounds with well defined molecules; an equivalent of acid is to be understood as the amount that would provide one gram atom of hydrogen atoms upon complete ionization; and an equivalent of the salt of such an acid is to be understood as the amount of the salt that requires the replacement of some other cations with one gram atom of hydrogen ions to regenerate the free acid.

SUMMARY OF THE INVENTION

One embodiment of a composition according to this invention, specifically a composition suited for direct use as such in cleaning plastic surfaces, which may be denoted hereinafter as a "working composition", is an acidic aqueous liquid solution that has a foam volume of not more than 25 milliliters (hereinafter usually abbreviated "mL") from 150 mL of the composition when measured according to the test described below and that comprises, preferably consists essentially of, or more preferably consists of, water and:

(A) hydroxycarboxylic and/or dicarboxylic acid or acids;

(B) nonionic surfactant; and, optionally, one or more of the following:

(C) salts including anions of hydroxycarboxylic and/or dicarboxylic acid or acids, preferably anions of the same acid or acids as specified for part (A); and (D) a sufficient amount of hydrotrope material to produce a stable homogeneous solution or dispersion of components (A) through (C) in water; and (E) a sufficient amount of a biocidal material to inhibit growth of any bacteria and/or fungi that may be present in the composition.

Foaming potential for purposes of this description is measured by a test using 150 mL of cleaning composition, ready for actual use in cleaning, in a glass stoppered graduated cylinder with at least 250 ml capacity. The cylinder and its contents are brought to temperature equilibrium by any convenient method, usually a controlled temperature bath, and then are vigorously shaken up and down by hand, while upright with the stopper in place, ten times in quick succession. Immediately after this shaking is completed, the cylinder is placed upright on a horizontal table and the stopper is removed. A timer is started immediately after the stopper has been removed. The foam volume is determined from the graduations on the cylinder by noting the difference between the graduations at the top of the foam and at the top of the underlying liquid composition in the cylinder at a time 15±1 seconds after the timer was started.

Another embodiment of the invention is an aqueous concentrate that can be diluted with water only to produce, optionally after adjustment of pH by adding acid or base, a composition as given above ready for use as such in cleaning plastic surfaces. The term "water only" herein is intended to include water from normal domestic and industrial water supplies as well as deionized, distilled, or other specially purified water.

A process according to this invention comprises contacting a soiled plastic surface with a suitable composition according to the invention as described above for a sufficient time at a sufficiently high temperature to achieve the desired amount of soil removal.

DESCRIPTION OF PREFERRED EMBODIMENTS

Within the broadest scope of the invention, any organic acid made up of molecules of which each contains at least one carboxyl group and at least one hydroxyl or additional carboxyl group may be used for ingredient (A) above. Thus, for example, gluconic acid, hydroxyacetic acid, succinic acid, fumaric acid, potassium acid phthalate, tartaric acid, malonic acid, and citric acid could all be used. Preferably, component (A) is made up of molecules with not more than six carbon atoms each and with at least three, or more preferably, at least four, total —OH and —COOH groups per molecule. The most preferred acid for ingredient (A) is citric acid. In a working composition according to the invention, the concentration of the total of component (A) and component (C) when the latter is present preferably is, with increasing preference in the order given, not less than 0.4, 0.8, 1.2, 1.6, 2.0, 2.4, 2.8, 3.2, 3.4, 3.6, 3.8, 4.0, 4.2, 4.4, 4.5, 4.6, 4.7, or 4.75 milliequivalents per kilogram (hereinafter usually abbreviated as "mEq/kg") and independently preferably is, with increasing preference in the order given, not more than 10, 9, 8, 7.5, 7.0, 6.5, 6.0, 5.7, 5.4, 5.2, 5.1, 5.0, or 4.95 mEq/kg.

Within the broadest scope of the invention, any conventional non-ionic surfactant that is water soluble or dispersible may be used for component (B). Preferred molecules for this component are generally those made by, or having a structure that could be made by, condensing fatty alcohols with suitable amounts of ethylene oxide, and optionally also with some propylene or other higher alkylene oxides, as generally known in the art. The hydrophile-lipophile-balance (hereinafter usually abbreviated as "HLB") value of component (B) independently preferably is, with increasing preference in the order given, not less than 6, 7, 8, 9, 9.5, 10.0, 10.5, 10.7, 10.9, 11.1, 11.2, 11.3, 11.4, or 11.5 and independently preferably is, with increasing preference in the order given, not more than 18, 16, 15, 14, 13, 12.7, 12.4, 12.2, 12.0, 11.9, 11.8, or 11.7. Independently, the concentration of component (B) in a working composition according to the invention preferably is, with increasing preference in the order given, not less than 0.21, 0.40, 0.60, 0.74, 0.87, 0.90, 0.95, 0.97, 1.00, 1.03, 1.05, 1.07, 1.09, or 1.10 g/kg and independently preferably is, with increasing preference in the order given, not more than 10, 7, 4, 3.3, 3.0, 2.6, 2.4, 2.2, 2.0, 1.8, 1.6, 1.5, 1.4, 1.3, or 1.2 g/kg.

A hydrotrope is defined generally as a substance that increases the solubility in water of another material that is only partially soluble. Within the context of this specification, a hydrotrope is a material that increases the solubility in water, and more particularly in water containing substantial amounts of salts, of component (B) as defined above. Hydrotrope component (D) is usually preferred in the composition if there is a relatively large amount of salt present in the composition, salt which might otherwise tend to reduce the solubility of non-ionic detergents to a level where the ability of the composition to remove and disperse organic soils is less than is desirable. The presence of a hydrotrope, preferably an ammonium or alkali metal salt of a sulfonate of toluene, xylene, or cumene, makes possible the presence of relatively high amounts of both salt and nonionic surfactant in an aqueous solution. The most preferred hydrotrope is sodium cumene sulfonate.

A concentration in grams per kilogram (hereinafter usually abbreviated "g/kg") of hydrotrope equal to from one quarter to three quarters of the concentration, or more preferably from 35 to 45% of the concentration, of salt component (C) present is generally preferred when component (C) is present, but a hydrotrope may also be useful in compositions even without component (C), to solubilize some or all of the nonionic surfactants in component (B). Thus, independently, especially when component (C) is not present in the composition, the amount of hydrotrope preferably is, with increasing preference in the order given, not less than 2, 4, 7, 12, 13, 14, 15, 16, or 17 g/kg, and independently preferably is, with increasing preference in the order given, not more than 50, 40, 35, 30, 27, 24, 22, 20, or 19 g/kg, of a total concentrate composition.

As already noted above, one of the major objects of this invention is to avoid phosphate pollution. It is therefore increasingly more preferred that the compositions according to this invention contain no more than 2, 1, 0.5, 0.25, 0.1, or 0.01 percent by weight of phosphate or other phosphorus containing anions produced by the ionization of phosphoric or condensed phosphoric acids. Similarly, to avoid air pollution and fire hazards, it is increasingly more preferred that the compositions according to this invention contain no more than 2, 1, 0.5, 0.25, 0.1, 0.07, 0.05, 0.03, 0.02, or 0.01 percent by weight of organic materials with a boiling point lower than that of water or of other volatile organic compounds.

The choice of pH and total acid content of a composition according to this invention generally requires some compromise between cleaning effectiveness and corrosive effect on the metal containers and/or other metal equipment generally used in connection with the cleaning process or for storing and transporting cleaning compositions. Lower pH and higher total acidity generally are favorable to consistency of cleaning and prolong the useful life of a cleaning composition, but these characteristics of the cleaning composition also promote corrosion, particularly of mild steel equipment which is in common commercial use in contact with the cleaning compositions. In order to select the optimum composition according to this invention it is therefore normally necessary to consider both cleaning effectiveness and corrosion risk. This will be illustrated in connection with the examples below. However, when corrosion is not a problem, considerably more acidic compositions according to the invention are highly effective. Thus, if corrosion is not a problem in the use of the compositions according to this invention, the pH value of a working composition preferably is, with increasing preference in the order given, not less than 1.0, 1.5, 1.7, 1.9, 2.1, 2.2, 2.3, 2.4, 2.5, 2.6, or 2.7 and independently preferably is, with increasing preference in the order given, not more than 4.0, 3.7, 3.5, 3.3., 3.1, 3.0, or 2.9. On the other hand, when a working composition according to the invention is to be used in a mild steel container, the pH value of the working composition preferably is, with increasing preference in the order given, not less than 4.4, 4.5, 4.6, 4.7, 4.8, 4.9, 5.0, 5.1, or 5.2 and independently preferably is, with increasing preference in the order given, not more than 6.1, 6.0, 5.9, 5.8, 5.7, 5.6, 5.5, 5.4, or 5.3.

The major motive for providing a high buffer capacity in compositions according to the invention which are bufferred by the inclusion of optional component (C) as described above is to provide substantial consistency of cleaning effect as the composition is used, even when the pH of a working composition according to this invention is high enough to avoid serious corrosion of mild steel containers for the composition. This is particularly important when part of the cleaning involves removing alkaline types of soils, and also when the plastic being cleaned contains alkaline filler materials, such as the very commonly used calcium carbonate. In such cases, it eventually becomes advantageous to replenish the acid constituent of the composition as it is consumed during use. However, to minimize the frequency of such replacement needed, when the pH of a working composition is above 4.4, the bufferring capacity of the composition preferably is high enough to require, with increasing preference in the order given, at least 0.06, 0.10, 0.15, 0.19, 0.23, 0.26, 0.27, 0.28, 0.29, or 0.30 milliequivalents of a strong base per liter of the composition must be added to raise the pH value of the composition by 0.1 pH unit.

For practical reasons that will be apparent to those skilled in the art, it is strongly preferred to choose components for cleaning compositions according to this invention that have relatively low foaming characteristics at the temperature of actual use. In general, it has been observed that most compositions according to this invention, when measured by the test described above, will have large foam volumes at normal ambient temperatures, but that the amount of foam will decrease dramatically at some temperature below that normally used and preferred for cleaning. This is illustrated below in connection with the specific working examples. It is increasingly more preferred that the foam volume, measured as described above, of a composition for cleaning according to this invention be not more than 25, 20, 15, 12, 10, 8.0, 6.0, 5.0, 4.0, 3.0, 2.0, 1.0 or 0.5 mL at the temperature of actual use for cleaning. If the temperature of intended use is not known, it is increasingly more preferred that the same values for foam volume not be exceeded at 60°, 54°, 43°, or 32° C.

It is normally preferred that a concentrate according to the invention have a composition such that a solution of from 0.5 to 3%, or most preferably 2%, by weight of the concentrate in water will be suitable for direct use for cleaning plastics as described above, possibly after pH adjustment as previously noted.

Contacting between the surface and the liquid composition in a process according to the invention may be accomplished by any convenient method, such as immersing the surface in a container of the liquid composition, spraying the composition on the surface, or the like, or by a mixture of methods. Any temperature between just above the freezing point and just below the boiling point of the liquid cleaning composition may generally be used, with a temperature of 40° to 70° C. generally preferred and 50°–60° C. more preferred, with the preference strongly influenced by the reduction in the amount of foaming that has been observed at higher temperatures. At the preferred temperatures, a time of contact of from 20–120 seconds is generally preferred, with from 45–75 seconds more preferred.

After cleaning as described immediately above, it is generally preferred to rinse the cleaned surface with water to remove any residue of the cleaning composition before subsequent use or surface finishing of the cleaned plastic. Most preferably, at least the last such rinse should be with deionized or other purified water. Usually, the rinsed surface should then be dried before subsequent finishing treatments. Drying also may be accomplished by any convenient method, such as a hot air oven, exposure to infra-red radiation, microwave heating, or the like.

The practice of this invention may be further appreciated from the following, non-limiting, working examples.

EXAMPLE 1

For this example, a concentrate composition according to the invention was prepared from the following ingredients ("PBW"=parts by weight) by the following procedure: 20.0 PBW of citric acid was dissolved in 250 PBW of deionized ("DI") water. An amount of 13.0 PBW of 50% by weight of aqueous sodium hydroxide solution was added to this mixture with stirring until there was a uniform appearance throughout the solution. An amount of 5.0 PBW of 60% by weight of aqueous fluotitanic acid was then added, again with stirring until there was a uniform appearance throughout the solution. To this mixture were then added in succession with stirring 200 PBW of DI water, 25 PBW of sodium cumene sulfonate (commercially available as NAXONATE™ SC from Ruetgers-Neace Chemical Co., State College, Pa.), 20.0 PBW of WITCONOL™ 1206 (a modified oxyalkylated alcohol, commercially available from Witco Corp., New York), 5.0 PBW of TRITON™ X-100 (octylphenoxy polyethoxy ethanol with a Hydrophile-Lipophile Balance of 13.5, commercially available from Rohm & Haas Co., Philadelphia), 5.0 PBW of MAKON™ NF 12 (polyalkoxylate on an aliphatic base, commercially available from Stepan Co., Northfield, Ill.), and 457 PBW of DI water.

The concentrate as described immediately above was diluted with tap water to provide a 2% by weight amount of the concentrate in a composition for cleaning. This diluted composition was then adjusted with sodium hydroxide to give a pH of 5.2 and was tested for cleaning effect at 52° C. with 75 seconds spraying contact on the soils and plastic substrates shown in Table 1, with the results also shown there. (The soils shown in Table 1, which are representative of types of soil commonly encountered in an automobile manufacturing plant, were deliberately applied to the plastic test panels in a uniform manner for the purpose of these tests.)

TABLE 1

CLEANING RESULTS WITH COMPOSITION OF EXAMPLE 1

| | Effectiveness of Cleaning from: | | |
|---|---|---|---|
| Soil Type | PCO[1] | TPO[2] | PPO[3] |
| Mold release soap | Clean | Clean | Clean |
| Wax | Trace left | Part left | Clean (WB) |
| Lock lubricant | Part left | Not removed | Clean (WB) |
| Human skin oil | Clean | Clean | Clean |
| Motor oil | Clean | Not removed | Clean (WB) |

Footnotes for Table 1
[1]LEXAN ™ from General Electric Co.
[2]Supplied by Republic Plastics Co.
[3]NORYL ™ GTX 910 from General Electric Co.
Other Notes for Table 1
"Clean" means that the test panel was free from any visual evidence of the type of soil indicated and free from water breaks after rinsing with water in the area of the test panel where the specified type of soil was present before cleaning, except when followed by "(WB)", which indicates that water breaks were observable even though there was no visually detectable amount of soil remaining.

The composition ready for cleaning use as described above was also tested for its corrosive effect on cold rolled mild steel panels 10 by 15 centimeters in size. Panels were degreased in acetone, then dried and accurately weighed. Weighed panels were sprayed for 2 hours with the cleaning composition at 52° C., then rinsed with DI water, dried, and again weighed accurately to determine weight loss. The average weight loss per panel on six panels was 0.27 grams, with an average deviation of 0.04 grams. When the corrosion testing was repeated, except that less NaOH was added after dilution of the concentrate so that the initial pH was 4.4, the average corrosion rate was about ten times higher. This higher corrosion rate is likely to be unacceptable, so that when using this particular embodiment of the cleaning composition according to this invention in a mild steel container, it is important to keep the pH above 5.

The buffering capacity of this composition is sufficiently high that at least 0.10 milliequivalents of strong base per liter of the composition must be added to raise the pH of the composition by 0.1 pH unit.

EXAMPLE 2

For this example, a concentrate composition according to the invention was prepared from the following ingredients by the following procedure: 60 PBW of a 50% by weight aqueous solution of gluconic acid was dissolved in 250 PBW of deionized DI water. An amount of 11.0 PBW of 50% by weight aqueous sodium hydroxide solution was added to this mixture with stirring until there was a uniform appearance throughout the solution. To this mixture were then added in succession with stirring 205 PBW of DI water, 25 PBW of sodium cumene sulfonate, 20.0 PBW of WITCONOL™ 1206, 5.0 PBW of TRITON™ X-100, 5.0 PBW of MAKON™ NF 12, and 419 PBW of DI water.

The concentrate as described immediately above was diluted with DI water to provide a 2% by weight amount of the concentrate in a composition suitable for cleaning. This composition was tested for its corrosive effect by immersing half of each of several corrosion test panels of the same type as used in Example 1 in a container of the cleaning composition initially at 60° C. The panels remained in the cleaning composition overnight, but the temperature gradually declined to room temperature. Corrosive weight loss averaged only 0.033 grams per total panel equivalent. However, the buffering capacity of this gluconic acid containing composition is lower than that of the citric acid based composition of Example 1, so that it would not be expected to last nearly as long without replenishment in practical use.

EXAMPLE 3

For this example, a concentrate composition according to the invention was prepared from the following ingredients by the following procedure: 45 PBW of sodium citrate and 22 PBW of citric acid were dissolved in 660 PBW of DI water. An amount of 6.8 PBW of 50% by weight of aqueous sodium hydroxide solution was added to this mixture with stirring until there was a uniform appearance throughout the solution. To this mixture were then added in succession with stirring 27 PBW of sodium cumene sulfonate, 0.8 PBW of sodium bisulfite (added for its biocidal effect), 86.0 PBW of DF 16™ (a modified polyethoxylated alcohol nonionic surfactant with Chemical Abstracts Registry No. 68603-25-8, commercially available from Rohm & Haas Co.), and 152.4 PBW of DI water.

To make a suitable composition for immediate use in cleaning, the concentrate described above may, for example, be diluted with tap or DI water to give a composition containing 2% by weight of the concentrate, and sufficient NaOH or citric acid added to this diluted composition to give a pH of 5.25±0.25. As this composition is used for cleaning, the pH tends to rise, and most preferably additional citric acid is added, usually from aqueous solution, as necessary to keep the pH within the specified range.

The foam volumes developed at various temperatures were measured by the method described above for a sample of a composition made by dissolving the concentrate prepared for this example in DI water to give a solution containing 2% of the concentrate by weight. The foam volumes found are shown in Table 2 below. The buffering capacity of this composition is sufficiently high that at least 0.30 milliequivalents of strong base per liter of the composition must be added to raise the pH of the composition by 0.1 pH unit.

TABLE 2

FOAM VOLUMES FOR A COMPOSITION MADE BY DILUTING A CONCENTRATE ACCORDING TO EXAMPLE 3

| Temperature, °C.: | 21 | 27 | 31 | 37 | 43 | 49 | 60 |
|---|---|---|---|---|---|---|---|
| Foam Volume, mL: | 112 | 112 | 24 | 22 | 14 | 4 | <1 |

EXAMPLE 4

This example illustrates compositions according to the invention without any component (C). The concentrate for this example had the following composition per kilogram: 47.5 g of anhydrous citric acid, 18.0 g of NAXONATE™ SC; 57.0 g of TRITON™ DF-16, 0.8 g of anhydrous sodium hydrogen sulfite, and the balance deionized water. A solution of 2% of this concentrate in water produces a highly effective working cleaner for plastics as generally described above.

What is claimed is:

1. An aqueous liquid concentrate that when diluted with 49 times its own weight of water forms a liquid cleaning composition that has a foam volume of not more than 25 mL from 150 mL of the composition at 60° C. and that consists essentially of water and:

(A) a component selected from the group consisting of hydroxycarboxylic and dicarboxylic acids;

(B) from about 0.21 to about 10 g/kg of nonionic surfactant selected from the group consisting of condensates of fatty alcohols with ethylene oxide, said condensates having an HLB value of from about 6 to about 18 and optionally containing higher alkylene oxides; and (C) from about 0.04 to about 1.0 g/kg of a hydrotroping component selected from the group consisting of the ammonium and alkali metal salts of sulfonates of toluene, xylene, and cumene, the total concentration of component (A) and of any salts of hydroxycarboxylic and dicarboxylic acids present in the composition being from about 0.4 to about 10 mEq/kg.

2. An aqueous liquid concentrate according to claim 1, wherein, after dilution, the concentration of component (B) is from about 0.40 to about 7 g/kg, the total concentration of component (A) and of any salts of hydroxycarboxylic and dicarboxylic acids present in the composition is from about 0.8 to about 9 mEq/kg, and the composition optionally contains one or more of the following components:

(D) salts including anions selected from the group consisting of the anions of hydroxycarboxylic and dicarboxylic acids;

(E) a sufficient amount of a biocidal material to inhibit growth of any bacteria and fungi that may be present in the composition.

3. An aqueous concentrate according to claim 2 wherein, after dilution, the concentration of component (B) is from about 0.60 to about 4 g/kg, the total concentration of component (A) and of any component (D) present in the composition is from about 1.2 to about 8 mEq/kg, and the concentration of component (C) is from about 0.08 to about 0.8 g/kg.

4. An aqueous concentrate according to claim 3 wherein, after dilution, the concentration of component (B) is from about 0.74 to about 3.3 g/kg, the total concentration of component (A) and of any component (D) present in the composition is from about 2.4 to about 7.0 mEq/kg, and the concentration of component (C) is from about 0.14 to about 0.70 g/kg.

5. An aqueous concentrate according to claim 4 wherein, after dilution, the concentration of component (B) is from about 0.60 to about 4 g/kg, the HLB value of component (B) is from about 9.5 to about 13, the total concentration of component (A) and of any component (D) present in the composition is from about 2.8 to about 6.5 mEq/kg, and the concentration of component (C) is from about 0.24 to about 0.60 g/kg.

6. An aqueous concentrate according to claim 5 wherein, after dilution, the concentration of component (B) is from about 0.74 to about 3.3 g/kg, the total concentration of component (A) and of any component (D) present in the composition is from about 3.2 to about 5.7 mEq/kg, and the concentration of component (C) is from about 0.26 to about 0.54 g/kg.

7. An aqueous concentrate according to claim 6 wherein, after dilution, the concentration of component (B) is from about 0.87 to about 2.6 g/kg, the total concentration of component (A) and of any component (D) present in the composition is from about 3.6 to about 5.4 mEq/kg, and the concentration of component (C) in a concentration from about 0.27 to about 0.48 g/kg.

8. An aqueous concentrate according to claim 7 wherein, after dilution, the concentration of component (B) is from about 0.95 to about 2.0 g/kg, the total concentration of component (A) and of any component (D) present in the composition is from about 4.0 to about 5.4 mEq/kg, and the concentration of component (C) is from about 0.32 to about 0.44 g/kg.

9. An aqueous concentrate according to claim 8 wherein, after dilution, the concentration of component (B) is from about 1.03 to about 1.8 g/kg, the HLB value of component (B) is from about 11.1 to 11.9, and the total concentration of component (A) and of any component (D) present in the composition is from about 4.4 to about 5.1 mEq/kg.

10. An aqueous concentrate according to claim 9 wherein, after dilution, the concentration of component (B) is from about 1.10 to about 1.3 g/kg, the total concentration of component (A) and of any component (D) present in the composition is from about 4.7 to about 5.0 mEq/kg, and the concentration of component (D) is from about 0.34 to about 0.40 g/kg.

11. A process of cleaning a soiled plastic surface by contacting, for a time of about 45 to about 75 seconds, the soiled plastic surface with an aqueous liquid cleaning composition having a pH in the range from about 2.7 to about 2.9 and a temperature in the range from about 50° to about 60° C. and consisting essentially of water and about 2% of a concentrate composition according to claim 10, then discontinuing contact between the plastic surface and the aqueous liquid cleaning composition and rinsing the plastic surface with water.

12. A process of cleaning a soiled plastic surface by contacting, for a time of about 20 to about 120 seconds, the soiled plastic surface with an aqueous liquid cleaning composition having a pH in the range from about 2.6 to about 3.0 and a temperature in the range from about 50° to about 60° C. and consisting essentially of water and about 0.5 to about 3% of a concentrate composition according to claim 9, then discontinuing contact between the plastic surface end the aqueous cleaning composition and rinsing the plastic surface with water.

13. A process of cleaning a soiled plastic surface by contacting, for a time of about 20 to about 120 seconds, the soiled plastic surface with an aqueous liquid cleaning composition having a pH in the range from about 2.3 to about 3.3 and a temperature in the range from about 50° to about 60° C. and consisting essentially of water and about 0.5 to about 3% of a concentrate composition according to claim 8, then discontinuing contact between the plastic surface and the aqueous cleaning composition and rinsing the plastic surface with water.

14. A process of cleaning a soiled plastic surface by contacting, for a time of about 20 to about 120 seconds, the soiled plastic surface with an aqueous liquid cleaning composition having a pH in the range from about 2.2 to about 3.5 and a temperature in the range from about 50° to about 60° C. and consisting essentially of water and about 0.5 to about 3% of a concentrate composition according to claim 7, then discontinuing contact between the plastic surface end the aqueous cleaning composition and rinsing the plastic surface with water.

15. A process of cleaning a soiled plastic surface by contacting, for a time of about 20 to about 120 seconds, the soiled plastic surface with an aqueous liquid cleaning composition having a pH in the range from about 2.1 to about 3.7 and a temperature in the range from about 50° to about 60° C. and consisting essentially of water and about 0.5 to about 3% of a concentrate composition according to claim 6, then discontinuing contact between the plastic surface and the aqueous cleaning composition and rinsing the plastic surface with water.

16. A process of cleaning a soiled plastic surface by contacting, for a time of about 20 to about 120 seconds, the soiled plastic surface with an aqueous liquid cleaning composition having a pH in the range from about 1.9 to about 4.0 and a temperature in the range from about 40° to about 70° C. and consisting essentially of water and about 0.5 to about 3% of a concentrate composition according to claim 5, then discontinuing contact between the plastic surface and the aqueous cleaning composition and rinsing the plastic surface with water.

17. A process of cleaning a soiled plastic surface by contacting, for a time of about 20 to about 120 seconds, the soiled plastic surface with an aqueous liquid cleaning composition having a pH in the range from about 1.7 to about 4.0 and a temperature in the range from about 40° to about 70° C. and consisting essentially of water and about 0.5 to about 3% of a concentrate composition according to claim 4, then discontinuing contact between the plastic surface and the aqueous cleaning composition and rinsing the plastic surface with water.

18. A process of cleaning a soiled plastic surface by contacting, for a time of about 20 to about 120 seconds, the soiled plastic surface with an aqueous liquid cleaning composition having a pH in the range from about 1.5 to about 4.0 and a temperature in the range from about 40° to about 70° C. and consisting essentially of water and about 0.5 to about 3% of a concentrate composition according to claim 3, then discontinuing contact between the plastic surface and the aqueous cleaning composition and rinsing the plastic surface with water.

19. A process of cleaning a soiled plastic surface by contacting the soiled plastic surface with an aqueous liquid cleaning composition having a pH in the range from about 1.0 to about 4.0 and a temperature in the range from about 40° to about 70° C. and consisting essentially of water and about 0.5 to about 3% of a concentrate composition according to claim 2, then discontinuing contact between the plastic surface and the aqueous cleaning composition and rinsing the plastic surface with water.

20. A process of cleaning a soiled plastic surface by contacting the soiled plastic surface with an aqueous liquid cleaning composition having a pH in the range from about 1.0 to about 4.0 and consisting essentially of water and a concentrate composition according to claim 1, then discontinuing contact between the plastic surface and the aqueous cleaning composition and rinsing the plastic surface with water.

* * * * *